US005431023A

United States Patent [19]

Howard et al.

[11] Patent Number: 5,431,023

[45] Date of Patent: Jul. 11, 1995

[54] PROCESS FOR THE RECOVERY OF OXYGEN FROM A CRYOGENIC AIR SEPARATION SYSTEM

[75] Inventors: Henry E. Howard; Dante P. Bonaquist, both of Grand Island, N.Y.

[73] Assignee: Praxair Technology, Inc., Danbury, Conn.

[21] Appl. No.: 242,479

[22] Filed: May 13, 1994

[51] Int. Cl.[6] ..... F25J 3/00

[52] U.S. Cl. ..... 62/37; 364/501

[58] Field of Search ..... 62/21, 37; 364/501

[56] References Cited

U.S. PATENT DOCUMENTS

| | | | |
|---|---|---|---|
| 2,934,907 | 5/1960 | Scofield | 62/21 |
| 2,934,908 | 5/1960 | Latimer | 62/22 |
| 3,912,476 | 10/1975 | Mikawa et al. | 62/37 |
| 4,238,212 | 12/1980 | Anderson | 62/37 |
| 4,734,114 | 3/1988 | Tasaka et al. | 62/37 |
| 4,784,677 | 11/1988 | Al-Chalabi | 62/37 |
| 4,801,209 | 1/1989 | Wadlow | 356/417 |
| 4,842,625 | 6/1989 | Allam et al. | 62/22 |
| 5,084,081 | 1/1992 | Rohde | 62/37 |

*Primary Examiner*—Ronald C. Capossel

*Attorney, Agent, or Firm*—Cornelius F. O'Brien

[57] ABSTRACT

A process for recovery of oxygen from a cryogenic air separation system in which measured data at the input or output of a latent heat exchanger and measured data within a column is compared with preselected data so that any deviation therebetween can be used to produce a signal that will vary the input parameters of the system until there is no deviation between the measured data and preset data thereby insuring that the system will operate under preselected optimum conditioning.

25 Claims, 3 Drawing Sheets

TEMPERATURE DIFFERENCE (°C)
0.20
0.19
0.18
0.17
0.16
0.15
0.14
0.13
0.12
0.11
0.10
0.09
0.08
0.07
0.06
0.05
0.04
0.03
0.02
0.01
0
0
2
3
6
8
10
12
14
16
18
20
22
24
26
28
THEORETICAL STAGE LOCATIONS
O2Draw
Interstate Condenser/Reboiler
Liquid Air Feed
N2Draw

PROCESS FOR THE RECOVERY OF OXYGEN FROM A CRYOGENIC AIR SEPARATION SYSTEM

FIELD OF THE INVENTION

The present invention relates to a process for the recovery of oxygen at a constant quality and/or rate from a cryogenic air separation system preferably having an interstage condenser/reboiler.

BACKGROUND OF THE INVENTION

Conventional dual pressure processes are employed to separate air at cryogenic temperatures into oxygen and nitrogen. Air is first compressed to approximately 5–6 atm absolute and then subjected to rectification in a high and low pressure distillation column which are thermally linked to one another. The high pressure column operates under superatomospheric pressure corresponding to the pressure of the air feed. The air feed undergoes preliminary separation in the high pressure column into a liquid fraction of crude oxygen and a liquid fraction of substantially pure nitrogen. The two resulting liquids typically form the feed fraction and the rectification reflux for the low pressure distillation operation.

The relative volatilities of nitrogen and oxygen force oxygen to accumulate at the bottom stripping section of the low pressure distillation and nitrogen to accumulate at the top of the low pressure distillation.

Specifically, liquid and vapor are passed in countercurrent contact through one or more columns and the difference in vapor pressure between the oxygen and nitrogen cause nitrogen to concentrate in the vapor form and oxygen to concentrate in the liquid form. The lower the pressure in the separation column, the easier it is to separate air into oxygen and nitrogen due to higher relative volatilities. Accordingly, the final separation into product oxygen and nitrogen is generally carried out at a relatively low pressure, usually just a few pounds per square inch (psi) above atmospheric pressure.

The consistent production of oxygen and nitrogen require that the composition variables of the cryogenic air separation process remain constant throughout the production cycle. It has been observed, however, that disturbance causing a deviation in any one of the composition variables may change the process sufficiently so that inferior quality oxygen is produced and/or a reduction in the rate of production is encountered. This results in the inefficient operation of the cryogenic air separation process and in the production of poor quality oxygen product or reduced product oxygen flow.

To insure that the quality of the product produced and the efficiency of the process is maintained would require constant monitoring of the output rate and quality of product produced. An alternate source of product such as liquid which is vaporized when either the output rate or product quality deviate from a specified value is generally required. This approach is costly and time consuming and thereby an inefficient solution to the problem.

It is an object of the present invention to provide a cryogenic air separation process that can produce oxygen having a desired purity composition on a continuous basis minimizing or eliminating the need for an alternative source of product.

Another object of the present invention is to provide a cryogenic air separation process that employs an interstage condenser/reboiler that is automatically monitored and the data observed are compared with preselected data so that any deviation between the measured and preselected data will produce a control signal that can be used to adjust at least one of the input and/or output feeds of the system so that the quality and/or feed rate of the product is returned to its desired levels.

Another object of the present invention is to provide a cost effective and easy to operate process for producing oxygen and nitrogen from a cryogenic air separation system on a continuous basis.

The foregoing and additional objects will become fully apparent from the following description and drawings.

SUMMARY OF THE INVENTION

The invention relates to a process for the cryogenic separation of air to produce oxygen and nitrogen using at least one distillation column comprising the steps:

(a) introducing at least one feed of an oxygen-bearing fluid, preferably oxygen enriched fluid, and a nitrogen bearing fluid, preferably a nitrogen enriched-fluid into said distillation column whereby said fluids are separated into nitrogen-rich vapor and oxygen-rich liquid;

(b) introducing a cryogenic fluid into a condenser/-reboiler means, preferably disposed at the bottom of the column, in which said cryogenic fluid is isolated from the fluids in the column and is used to provide a reflux liquid or stepping vapor in the column to produce nitrogen-enriched vapor that then ascends to the top of the column and oxygen-rich liquid that gravitates to the bottom of the column;

(c) removing said oxygen-rich product at a desired oxygen purity level from the bottom and said nitrogen-rich product from the top of the column;

(d) determining a predetermined value for the relationship between a compositional variable at an input, output or within the consender/reboiler means and a composition variable within at least one area in the column that exhibits high sensitivity to process changes such that said relationship will produce the desired purity level of the output product; and (e) measuring the compositional variable at the input, output, or within the condenser/reboiler means and the compositional variable within at least one area of the column and comparing the relationship of these data with the predetermined value of step (d) and upon any deviation therebetween producing a command signal to vary at least one of the control input or output feeds of the system until the measured data are the same as the predetermined value of step (d) thereby insuring the continuous production of the output product at the desired purity level.

Preferably, the distillation column should have a second intermediate condenser/reboiler means disposed between the top of the column and the intermediate area in which the oxygen-enriched fluid is fed. This intermediate condenser/reboiler will impart to the liquid descending in the column a latent heat exchange so that a portion of the liquid can be vaporized and serve as an intermediate stripper vapor.

Preferably, the process of this invention could be performed in a conventional double column system in which feed air is fed into a higher pressure column where it is separated into nitrogen-enriched vapor and oxygen-enriched liquid. The nitrogen-enriched vapor would then be condensed whereupon both the nitrogen-enriched liquid and oxygen-enriched liquid can be fed to a low pressure column as described above where they are then separated into nitrogen-rich vapor and oxygen-rich liquid at a desired purity level. When using a double column system, the intermediate condenser/-reboiler means could be placed in the high pressure column and the compositional variable at the input or output could be measured in this column.

The term "column", as used in the present specification and claims means a distillation or fractionation column or zone, i.e., a contacting column or zone wherein liquid and vapor phases are countercurrently contacted to effect separation of a fluid mixture, as for example, by contacting of the vapor and liquid phases on a series or vertically spaced trays or plates mounted within the column or alternatively, on packing elements. For a further discussion of distillation columns see the Chemical Engineers' Handbook, Fifth Edition, edited by R.H. Perry and C.H. Chilton, McGraw-Hill Book Company, New York, Section 13, "Distillation" B.D. Smith, et al., page 13-3, The Continuous Distillation Process. The term, double column, is used to mean a higher pressure column having its upper end in heat exchange relation with the lower end of a lower pressure column. A further discussion of double columns appears in Ruheman "The Separation of Gases" Oxford University Press, 1949, Chapter VII, Commercial Air Separation.

Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will tend to concentrate in the liquid phase. Distillation is the separation process whereby heating of a liquid mixture can be used to concentrate the volatile component(s) in the vapor phase and thereby the less volatile component(s) in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is adiabatic and can include integral or differential contact between the phases. Separation process arrangements that utilize the principles of rectification to separate mixtures are often interchangeable termed rectification columns, distillation columns, or fractionation columns.

As used herein, the term "condenser/reboiler" means a heat exchange device wherein vapor is condensed by indirect heat exchange with vaporizing column bottoms thus providing vapor upflow for the column. The term "indirect heat exchange" means the bringing of two fluid streams into heat exchange relation without any physical contact or intermixing of the fluids with each other.

As used herein, the term "packing" means any solid or hollow body of predetermined configuration, size, and shape used as column internals to provide surface area for the liquid to allow mass transfer at the liquid-vapor interface during countercurrent flow of the two phases.

The compositional variable that can be measured at the input or output of the condenser/reboiler means can be temperature, pressure, oxygen content, nitrogen content, argon content, and the like. The cryogenic fluid for use in the condenser/reboiler means can be nitrogen, air, argon or any fluid capable of condensation at the liquid oxygen sump. The condenser/reboiler means is a latent heat exchanger and thus its compositional variables can effect the operation of the system. The compositional variables that can be measured at a selected area within the distillation column, preferably at the area that exhibits high sensitivity to process changes of the system, are temperature, pressure, oxygen content, nitrogen content, argon content and the like. To produce a certain oxygen-rich purity product, the relationship of a compositional variable at the input or output of the condenser/reboiler means (cryogenic fluid not transisting within the column) to a compositional variable at a selected area within the column, low pressure column in a double column system, can be determined, for example, by observation of trial process runs of the system along with calculated values. The relationship required to produce a specific oxygen-rich purity product can be fed into a conventional computer or the like. During operation of the system the same compositional variables can be measured at the condenser/reboiler means and the selected area within the column and the relationship of those data can be compared to the predetermined relationship value stored in the computer. Any derivation between the predetermined relationship value and the measured value can generate a command signal from the computer to change at least one of the compositional variables of the process until the predetermined relationship value and measured value are the same. This automatic control of the process will cost effectively produce a desired oxygen-rich purity product on a continuous basis with little or no downtime. The variables of the process that can be adjusted are the feed rate of the oxygen-enriched fluid and nitrogen-enriched fluid, temperature of input or output feeds, pressure within the column, oxygen product flowrate, air flow, and flows into or outfrom the condenser/reboiler. For example, the relationship of temperature at condenser/reboiler means and the temperature at the preselected area within the column can be determined for producing a desired oxygen-rich purity product and then the temperature at these locations can be measured during the operation of the system and if the relationship value is not the same, then an input feed, such as feed rate of the oxygen enriched fluid could be varied until the values are the same. This will permit ideal process conditions to be maintained during the product run and thereby produce a desired oxygen-rich product on a continuos basis.

The compositional variable within the column could be nitrogen for which a temperature measurement could be used and then the nitrogen content could be computed from the relationship between temperature and the nitrogen content of a saturated fluid at a known pressure. For example, by dealing with liquids and vapors at saturation (vapor liquid equilibrium), when knowing two of the three variables (temperature, pressure, composition), the remaining variable can be determined. If conventional tray technology is used, temperature measurements can be retrieved from any point on the tray where a representative measurement of the fluid can be obtained. For instance, the active area of the tray where liquid/gas mass transfer occurs or the tray downcomer are representative examples where temperature measurements may be taken. If structured column packing is used, any means for obtaining a representative measurement in a section can be utilized, such as for example, at a location where the pool of liquid rests upon a liquid redistributor. Any conventional device may be used to retrieve a temperature measurement including, for example, a conventional thermocouple, vapor pressure thermometer or more preferably a resistance temperature device (RTD). The temperature measurement can also be referenced against any other direct or indirect measurement of composition. Although temperature is the preferred variable measurement, it is clearly within the scope of the present invention to make other compositional measurements such as pressure, or direct interbed measurement, using, for example, gas chromatography or mass spectrophotometry to determine the nitrogen content. Once a compositional measurement is taken, the nitrogen content is computed from a correlation defining the relationship between nitrogen content in the selected area of the column and the compositional measurement. This is established by formulating a mathematical model which will yield the nitrogen concentration through estimation techniques. The mathematical model may be formulated by non-linear thermodynamic simulation or by actual plant data. The actual plant data may represent liquid samples taken at sensitive tray locations within the column to provide the compositional measurement. A preferred method for computing the nitrogen content in each stage of rectification from the compositional measurement is by use of linear and/or non-linear regression techniques. Representative examples of other techniques of correlation include the use of the Dynamic Kalman-Bucy Filter, Static Brosilow Inferential Estimator and the principal component regression estimator. The estimated result is indicative of the nitrogen content in the column. Although reference is made to a compositional measurement of a single stage of rectification, it is preferred to make two or more measurements at stages of rectification anywhere within regions of high process sensitivity.

If temperature is used as the compositional variable to be measured at each of the selected stages of rectification, the concentration of nitrogen may be derived from a formulated or model relationship using data generated from steady state simulations or actual plant operating data. The basic form of the mathematical expression defining the model relationship to be used in the computer simulations to compute total nitrogen content or temperature at the interstage condenser/reboiler location at the selected area would be as follows: $Y_a = (a)T_1 + (b)T_2 + (c)T_3 + \text{etc.}$—where $Y_a$ is the computed total content of nitrogen at the selected area and (a), (b) and (c) etc. are the derived coefficients of the stage temperatures T. Multiple linear regression may be used to determine the coefficients which will yield minimum error. Linear and non-linear regression techniques are well known and many computer programs are conventionally available to perform multiple linear regression. It should be noted that the above coefficients (a), (b) and (c) etc. are weighted values in computing the nitrogen content by summation.

In one embodiment of the invention, the process will provide an effective method for controlling the temperature profile of an air separation column utilizing an intermediate or interstage condenser/reboiler. This is accomplished by using the intermediate composition measurements of the fluids used in the intermediate condenser/reboiler and the compositional measurement within the column to enable the controller to effectively maintain a sufficient temperature difference for the latent heat transfer. The thermodynamic state sensing device suitable for this invention may be any combination of equipment required to obtain sufficient information for the system from which the command signal could be produced to maintain the system at a desired purity oxygen output. The command orders could be done manually or by way of signals from a conventional process control computer.

DETAILED DESCRIPTION OF THE DRAWINGS

Figure 1:
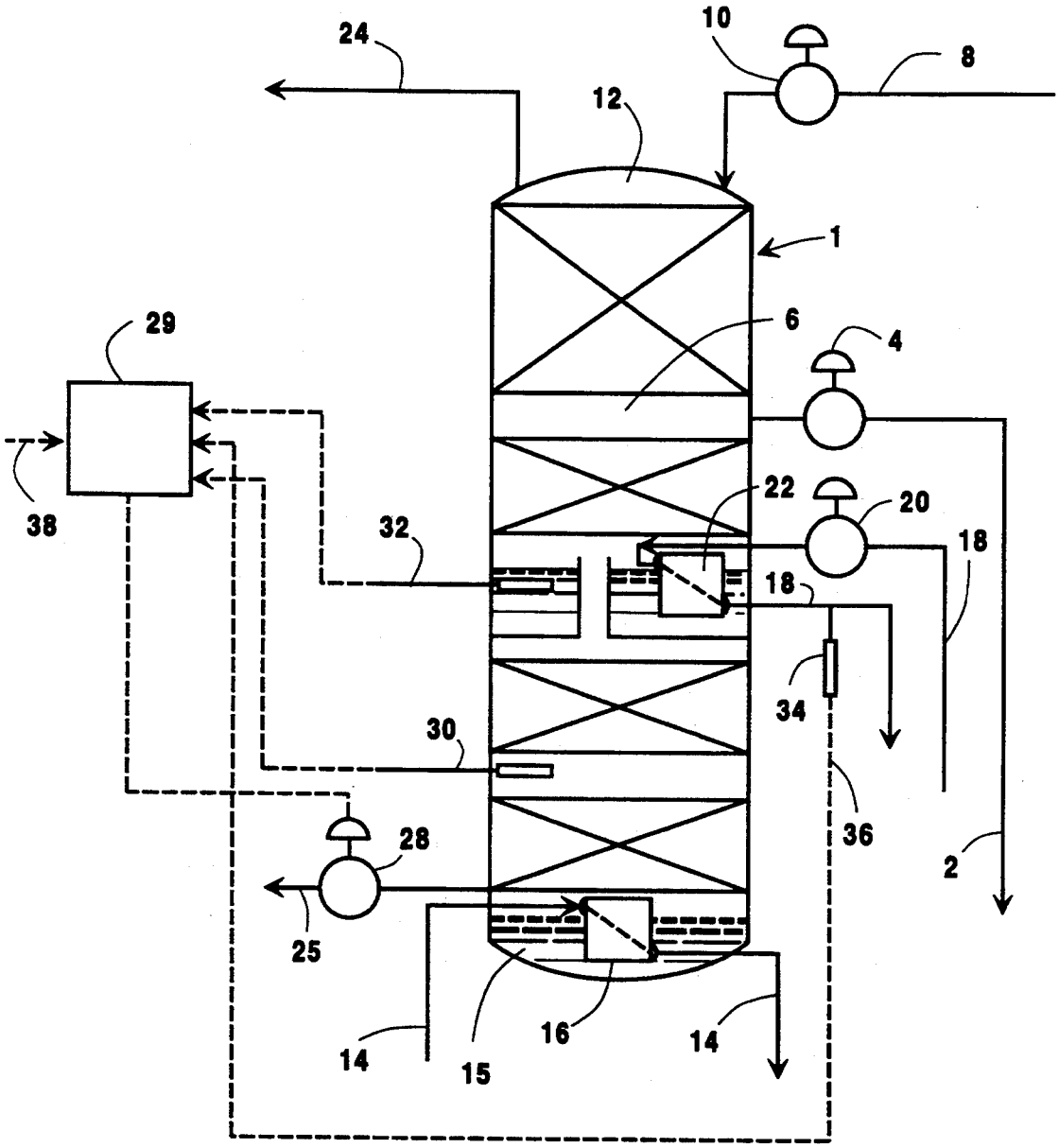
FIG. 1 is a schematic representation of one embodiment of the invention employing a single distillation column.

FIG. 1 shows a single low pressure distillation column 1 of the type used in a double-column system. An oxygen-enriched fluid 2 is fed through valve 4 into an intermediate area 6 of column 1. A nitrogen-enriched fluid 8 is fed through valve 10 into the top area 12 of column 1. The thermodynamic prerequisite between the composition of fluid 2 and fluid 8 is that fluid 8 should contain a quantity of nitrogen greater than the nitrogen contained in fluid 2. The reboil of column 1 is accomplished by condensing or partially condensing gaseous cryogenic fluid 14 within latent heat exchanger or condenser/reboiler unit 16. The liquid oxygen at the bottom 15 of column 1 is vaporized by the indirect heat exchange from condenser/reboiler unit 16 and the vapor produced serves as primary stripping vapor for column 1. An intermediate reboil in column 1 is accomplished by passing a cryogenic fluid 18 through valve 20 into a condenser/reboiler unit 22° A portion of the descending liquid within column 1 is vaporized by the indirect heat exchange from condenser/reboiler unit 22 and the vapor produced serves as an intermediate stripping vapor. This results is a nitrogen product 24 ascending to the top area 12 where it is withdrawn and an oxygen product 26 descending to the bottom area 15 where it is withdrawn.

Compositional sensing devices 30 and 32 obtain a measurement of the composition within the stripping section of column 1. The stripping section is bounded by the entry location of fluid 2 and the bottom area 15 of the column 1. Two measurements in this section of column are shown in FIG. 1. These measurements may comprise signals generated from a resistance temperature device, vapor pressure thermometer, gas chromatograph, mass spectrograph, paramegnetic analyzer or any other compositional sensing device capable of measuring oxygen or nitrogen. The measurement can consist of an estimate of the nitrogen or oxygen concentration at the column locations. It should be noted that the composition measurement/analysis need not be performed within the column. The inclusion of an appropriate sampling device (gas or liquid) and conduit will enable the compositional measurement to be performed exterior to the column or the coldbox. If desired, a separate vessel may contain 22, so that liquid could be extracted and fed to such a vessel where the analysis could be carried out.

A compsition/tempeature or pressure (and possibly sampling) sensing device 34 is shown located at the condensate side of condenser/reboiler unit 22 and a signal is fed to controller 29 (computer) via line 36. The signal from this device is directed to controller 29 and serves as an additional input for the computation of the output. The inclusion of this measurement will enhance process operability when the condenser/reboiler is located in a column position where there is high process sensitivity (rapid swings in temperature due to changes in nitrogen/oxygen content of the descending fluid). The signals obtained from compositional measuring devices 30, 32 and 34 are transmitted to controller means 29 where their values (or some derived values) are compared to a setpoint previously entered into the controller 29 as discussed above. Specifically, a preselected setpoint of the relationship between the compositional variable in column 1 and the compositional variable at the condenser/reboiler unit 22 is fed into controller 29 via line 38. An output signal is generated from controller 29 if a difference is detected between the setpoint value and the measured value and then the signal is directed to adjust a process flow or some other variable of the system. In reference to FIG. 1, this signal controls the positioning of valve 28 and consequently the flow of gaseous oxygen extracted from column 1. Selecting the positions of compositional measurements 30 and 32 based upon column 1 locations exhibiting high sensitivity to process changes will enable improved controllability. This improvement in column operation will manifest itself in fewer plant shutdowns and increased product recovery.

Figure 2:
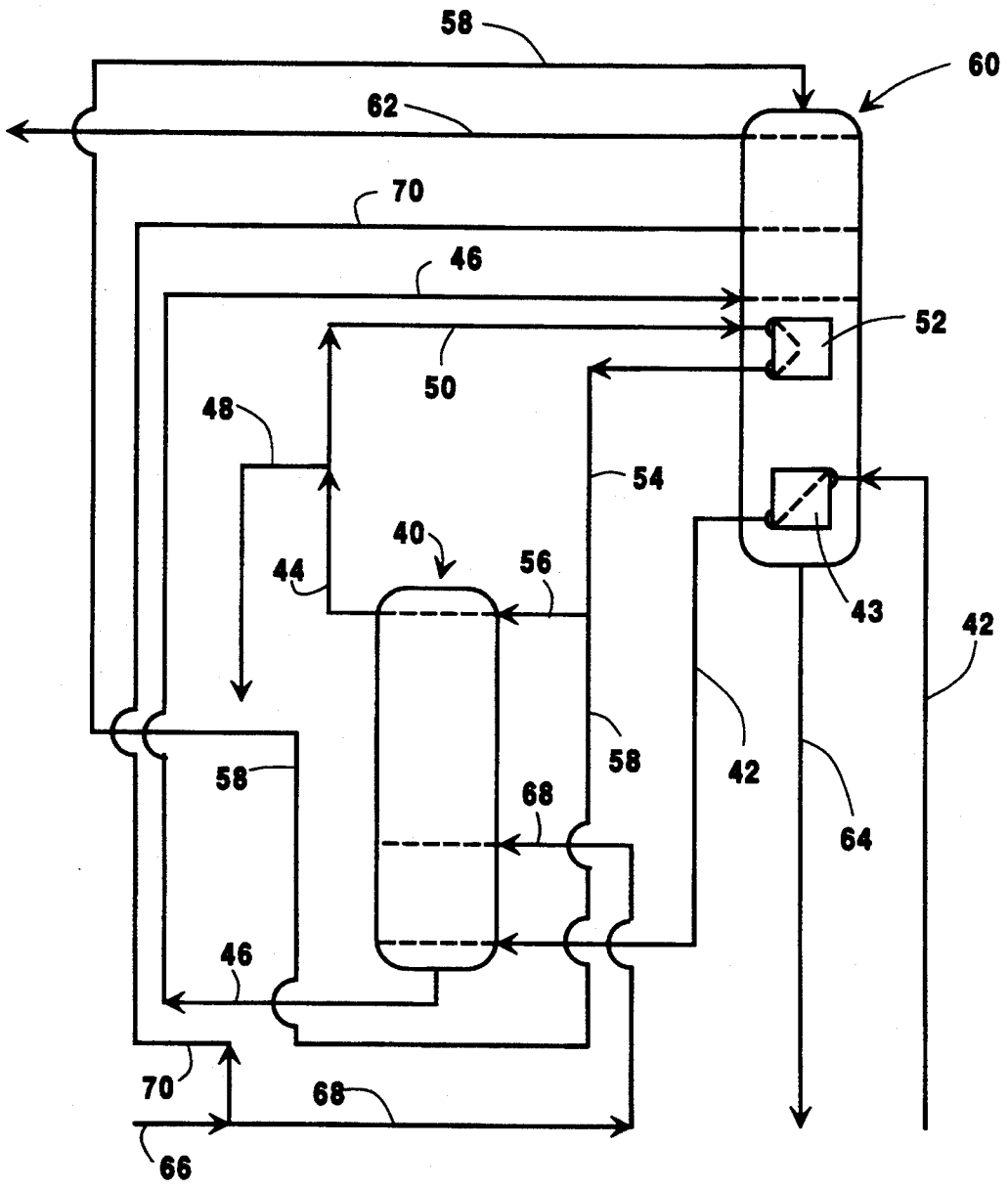
FIG. 2 is a schematic representation of a preferred embodiment of the invention employing a double-column cryogenic air separation system.

FIG. 2 shows a preferred embodiment of this invention employing a double column system. Specifically, a high pressure column 40 and low pressure column 60 are shown in which the primary air feed 42 is compressed, cleaned and cooled to a temperature close to its dewpoint by using conventional technology. This feed air 42 is subsequently partially liquefied in condenser/reboiler unit 43 of column 60 which is similar to the operation of column 1 of FIG. 1. The primary air feed 42 from unit 43 is then fed to the base of high pressure column 40 where it is rectified to a nitrogen overhead 44 (shelf vapor) and an oxygen enriched fluid 46 extracted from the base (kettle liquid) of column 40 and fed to column 60 as the enriched air supply.

The nitrogen overhead or shelf vapor 44 will typically comprise 0.1–2% $O_2$ mole fraction. In this particular case, the gaseous nitrogen overhead 44 is split after exiting the high pressure column 60. A portion of the nitrogen 48 is partially warmed and then extracted and turboexpanded for process refrigeration. The expanded nitrogen 48 is then warmed to ambient and may be taken as product or waste. The remaining nitrogen overhead 50 is condensed in the primary low pressure column at condenser/reboiler 52 which is analogous to interstage condenser/reboiler 22 shown in FIG. 1. The resulting liquefied nitrogen (shelf liquid) 54 is split into two streams. A portion 56 is directed to the top of the high pressure column 40 as reflux and the remaining portion of liquid nitrogen 58 is subcooled and introduced into the top of the low pressure column 60. This stream of liquid nitrogen reflux 58 corresponds to stream 8 of FIG. 1. Two products are formed from the low pressure column 60. Low pressure nitrogen gas 62 is extracted from the top of the column 60 and a low pressure liquid oxygen 64 is extracted from the base of the column 60. These two streams 62 and 64 would correspond to streams 24 and 26 of FIG. 1, respectively. Note that the oxygen 64 is withdrawn as a liquid in FIG. 2. Liquid oxygen of 90% or greater $O_2$ content can then be pumped to an elevated pressure and vaporized against an air stream that has been compressed to a pressure greater than that of the primary air feed. The vaporized oxygen and nitrogen can then be warmed to ambient and extracted as products.

A boosted air supply 66 which was liquified against vaporizing stream 64 may be split and fed as liquid feed air 68 which is fed to low pressure column 60 and feed air 70 which is fed to high pressure column 40. The operation of the double column system is known in the art.

The central features of this invention as described with reference to FIG. 1 can be incorporated into FIG. 2 with respect to the low pressure column 60. Specifically, the compositional variable at the input or output of the condenser/reboiler unit 52 can be measured and compared to the measurement of the compositional variable within column 60 below feed line 46. This relationship can be compared to a predetermined value based on a preselected oxygen purity output product so that any deviation between the measured value and preselected value will trigger a command signal from a computer 29 or the like to vary the control feeds or other variables to return the system to the preselected process conditions that will produce the desired oxygen purity product. Thus the novel features of this invention as explained with reference to FIG. 1 is applicable to FIG. 2.

Figure 3:
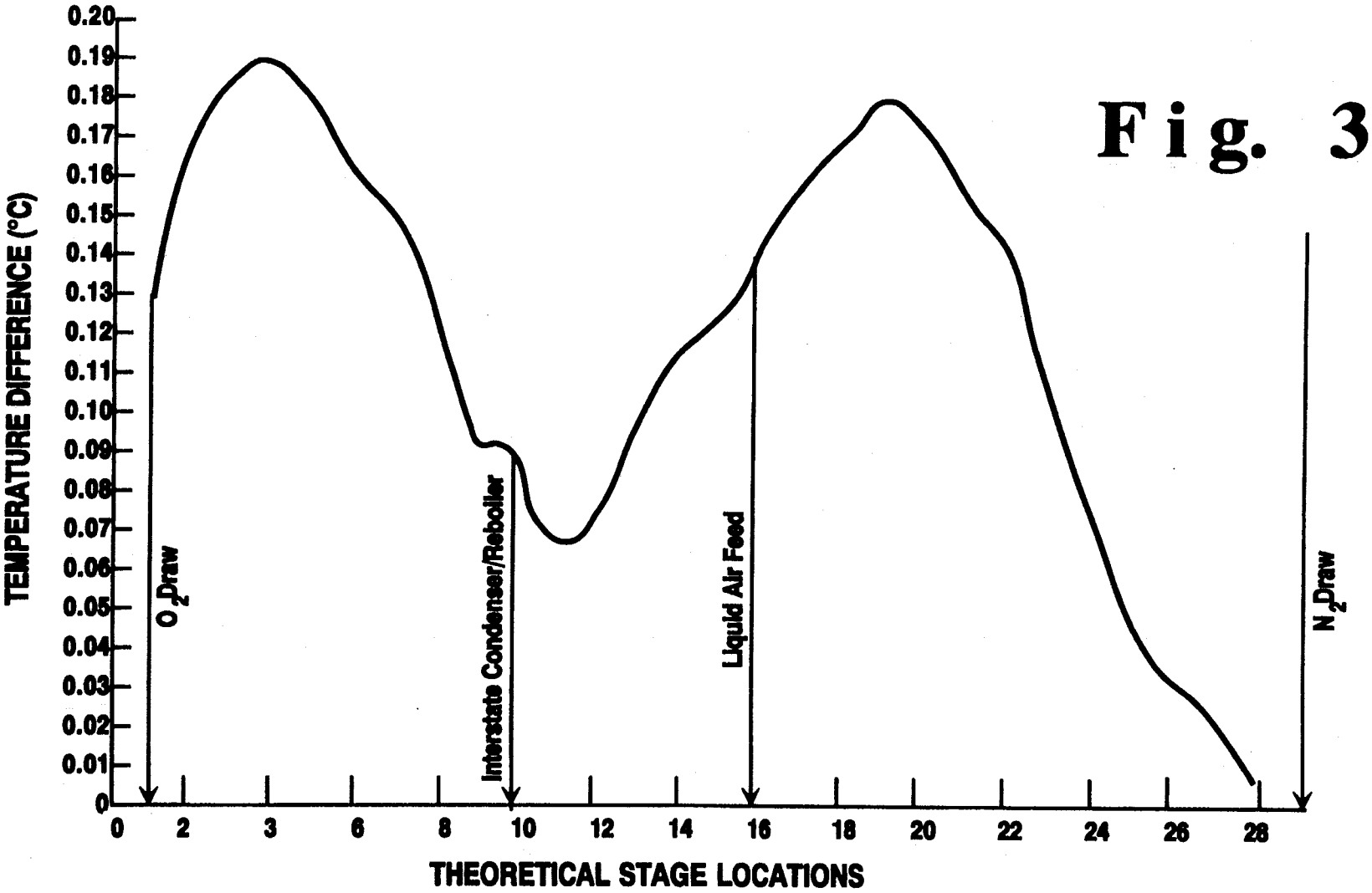
FIG. 3 is a graph showing the temperature difference at various stage locations of a distillation column due to a 0.48% decrease in the product oxygen flow.

FIG. 3 depicts a plot of the stage by stage temperature differences from a decrease of only 0.48 percent in product oxygen flow of a system as shown in FIG. 3. With respect to this cycle, there are two distinct peaks, one in the stripping section and one in the enriching section. Depending upon the cycle, the locations and size of these peaks will vary. Compositonal/temperature measurements can be located in the regions where the sensitivity is highest, in accordance with the present invention, e.g. stage 4 or stage 19 as shown in FIG. 3. This example is meant as an illustration of the invention and is not intended to imply that this is the only cycle to which the invention can be applied.

There are numerous air separation processes to which the present invention is applicable. Although the location of points of maximum column sensitivity and the degree of the sensitivity will vary from cycle to cycle, the basic principles of this invention can still be applied. Although not depicted in the accompanying figures, the principles of the invention can be applied to an interstage condenser/reboiler where interstage reflux is generated for the column. In this situation, the condensing fluid is rising column 1 vapor and the boiling fluid is external to column (segregated from the column fluids). One aspect of this invention refers to obtaining compositional measurements from the fluids within the column utilizing an interstage condenser/reboiler and the external fluid(s) used for the interstage condenser/reboiler operation. These measurements can then be used by a controller or computer to manipulate process flows in order to stabilize column operation. FIG. 1 depicts a single column and a single interstage condenser/-reboiler. Numerous air separation cycles utilize multiple columns and/or multiple condenser/reboilers. The present invention can be applied to each column section utilizing an interstage condenser/reboiler.

The output of controller 29 of FIG. 1 need not be used to manipulate the product oxygen flowrate. The output signal can be directed to any process flowrate or pressure (or combination) that will result in a change to the internal column reflux ratios. Examples of alternative manipulatable variables are the flow of reboil fluid 14 in FIG. 1. In a standard double column process (condensing nitrogen in latent heat exchanger 16 of FIG. 1) the condensing duty (and column vapor flow) can be controlled using the air flow to the base of the lower column or the nitrogen vapor flow diverted from condenser 16. If the process employs an interstage condenser (such as latent heat exchanger 22), the flow or pressure of stream 18 can be controlled via valve 20 in order to change the interstage reboil of the column. Liquid feeds such as streams 2 and 8 may be used to modify the reflux ratios within column 1 in response to the output of controller 29. As liquids, these fluids can be stored in additional holdup tanks/sumps not shown in FIG. 1. The use of these liquids as the manipulated variables (recipient of controller 29 output) can facilitate the control of rapid capacity modulations. In these situations, it is critical that the column not be completely depleted of liquid nor flooded.

Controller 29 may effect a traditional proportional-integral-derivative output, or it may constitute the computations required for multivariable model based control. In this situation, the signals derived from sensing devices 30, 32 and 34 will be included in the set of controlled variables. The resulting output of a multivariable controller may effect the manipulation of a combination of process flows simultaneously (e.g. streams 2, 8, 14, 26 and 36). The signals generated from sensing devices 30, 32 and 34 may be combined with other plant measurements to form additional measurements, composite measurements and/or controlled variables. FIG. 1 depicts two measurements comprising sensing devices 30 and 32. A single measurement can be used or numerous measurements can be obtained. These measurements may form a composite temperature (or compositional variable) prior to introduction into the control algorithm of controller 29.

The utilization of interstage condenser/reboilers is known to be a very effective means for reducing the thermodynamic inefficiencies and power consumption of many air separation cycles. There are numerous low purity oxygen processes and thermally integrated argon separations processes that possess an interstage condenser within the nitrogen stripping section. In almost every instance, the optimization of these processes forces the condenser to reside in a highly sensitive section of the column. As a consequence maintaining sufficient temperature driving force for latent heat transfer is of paramount importance. Without composition or temperature measurements, the implementation of these efficient processes is exceedingly difficult. Normal fluctuations in column operation can rapidly eliminate the temperature difference required for interstage condenser operation. This situation can easily lead to total operational shutdown. The present invention is intended to stabilize the composition (and temperature) profile of the column.

Several important options are available with regard to interstage condenser/reboiler processes. FIG. 1 depicts controller 29 utilizing the compostion or temperature of signal 38 as an input to controller 29. This composition or temperature as a setpoint input 38 to controller 29. FIG. 1 shows an embodiment where a composition or temperature device is located directly upon the stage of the interstage condenser/reboiler and this is a preferred location for a sensor. However this need not be the case. Using the composition or temperature of adjacent (or nearby) stages can enable an estimation of the interstage condenser/reboilers fluids temperature (and available driving force for latent heat transfer). As another alternative, if temperatures are used as the compositional measurements, a temperature difference (or effective temperature difference, relative to device 30 and 32) may be computed and a signal in relation to this value may be presented as the input signal of controller 29. Alternatively, this computation may form part of the algorithm carried out by controller 29.

It is possible to locate interstage condenser/reboilers exterior to the column in which reboil or reflux is generated. In these situations liquid is extracted from the column and sent to a separate vessel where the condenser/reboiler is located. Measuring the composition of the fluid contained within the vessel is the same as if the fluid was inside the primary fractionator. As previously indicated, there is no substantial difference in extracting a liquid from the column (by any known means) and then measuring its temperature or composition exterior to the column.

The use of structured column packing (or dumped packing) is now the predominant means for achieving mass transfer (distillation) within new air separation plants. Obtaining a composition or temperature measurement from a trayed distillation column is relatively straightforward (e.g. tray downcomer). This is not the case with a packed column sections. Redistribution points are the only easily accessible locations at which representative liquid samples may be extracted or analyzed. As a consequence, sensing/sampling devices 30 and 32 will most likely be located at column redistribution points as well as interstage condenser/reboiler locations.

EXAMPLE

A cryogenic air separation system could be used as basically shown in FIG. 1 and the compositional variable of temperature could be determined at the outlet of a condenser/reboiler unit as identified as 22 in FIG. 1. The compositional variable of temperature of liquid within the column could also be determined at location 32 as shown in FIG. 1. These readings could be fed into a computer 29 as shown in FIG. 1 to obtain a temperature difference. During the actual operation of the system, temperature difference between the temperature at the outlet of the condenser/reboiler and the temperature of liquid within the column as shown in FIG. 1 at 32 could be compared with the setpoint desired temperature difference input as the computer. Any deviation between the data would trigger a signal from the computer to vary the oxygen flow from the system. The signal would remain until there was no deviation between the measured temperature difference and the setpoint temperature difference, and thus the system would produce oxygen under preselected operating conditions on a continuous basis. The computer for use in this Example could be any conventional computer such as an IBM PC or compatible.

It is to be understood that although the present invention has been described with reference to particular details thereof, it is not intended that these details shall be construed as limiting the scope of this invention.

What is claimed:

1. A process for the cryogenic separation of air to produce enriched oxygen using at least one distillation column comprising the steps:

(a) introducing at least one oxygen and nitrogen-bearing fluid into the distillation column whereby said fluids are separated into nitrogen-enriched vapor that ascends to the top of the column and oxygen-enriched liquid which descends to the bottom of the column;

(b) introducing a cryogenic fluid into a condenser/-reboiler means wherein said cryogenic fluid is isolated from the fluids within the column and is used to provide a reflux liquid or a stripping vapor in the column to produce nitrogen enriched vapor that then ascends to the top of the column where it can be withdrawn and an oxygen-rich liquid that gravitates to the bottom of the column where it can be withdrawn;

(c) determining a predetermined value for the relationship between a compositional variable at an input, output or within the condenser/reboiler means and a compositional variable within at least one selected area in the column that exhibits high sensitivity to process change such that said relationship value will produce a desired purity output product;

(d) measuring the compositional variable at the input, output, or within the condenser/reboiler means and the compositional variable within at least one selected area of the column and comparing the relationship of these measured compositional variables with the relationship of the predetermined value of step (c) and upon any deviation therebetween producing a command signal for varying at least one of the control inputs or outputs of the process until there is no deviation from the measured value and predetermined value of step (c) thereby assuring continuous production of product at a desired purity level.

2. The process of claim 1 wherein said compositional variable is obtained from two selected areas within the column.

3. The process of claim 1 wherein said compositional variable at the condenser/reboiler means is selected from the group consisting of temperature, pressure, nitrogen and oxygen; and the compositional variable at the selected area is selected from the group consisting of temperature, pressure, nitrogen and oxygen.

4. The process of claim 1 wherein the compositional variable at the condenser/reboiler means is temperature or compositional variables that can be used to determine temperature; and the compositional variable at the selected area is temperature or compositional variables that can be used to determine temperature.

5. The process of claim 1 wherein said condenser/-reboiler means comprises a first condenser/reboiler device at the interstage of the column and the compositional variable is taken from the second condenser/-reboiler device.

6. The process of claim 5 wherein the command signal controls the oxygen production flow rate of the system.

7. The process of claim 5 wherein said compositional variable is obtained from two selected areas within the column.

8. The process of claim 7 wherein the compositional variable at the condenser/reboiler means is temperature or compositional variables that can be used to determine temperature; and the compositional variable at the selected area is temperature or compositional variable that can be used to determine temperature.

9. The process of claim 5 wherein said compositional variable at the condenser/reboiler means is selected from the group consisting of temperature, pressure, nitrogen and oxygen; and the compositional variable at the selected area is selected from the group consisting of temperature, pressure, nitrogen and oxygen.

10. The process of claim 1 wherein the command signal controls the oxygen production flow rate of the system.

11. A process for recovery of oxygen from a cryogenic air separation system having at least one low pressure distillation column containing multiple distillation stages of rectification and at least high pressure column providing a nitrogen rich reflux fluid to wash rising vapors in at least one low pressure column comprising the steps:

(a) introducing an oxygen enriched fluid into an intermediate area of the low pressure column;

(b) introducing a nitrogen enriched fluid from the high pressure column into the top area of the low pressure column above the intermediate area;

(c) introducing a cryogenic fluid at the bottom of the low pressure column into a first condenser/reboiler means to vaporize oxygen so that it serves as a stripping vapor;

(d) introducing a cryogenic fluid into a second condenser/reboiler means to partially vaporize the oxygen fluid;

(e) selecting a predetermined value for the difference between the input or output of one of the condenser/reboiler means and the composition variable at at least one selected area within the low pressure column that exhibits high sensitivity to process changes that will produce a desired oxygen purity product;

(f) measuring the composition variable at said at least one selected area within the low pressure column and the compositional variable at the input or output of said at least one condenser/reboiler means; and (g) comparing the measured data in step (b) and the selected data in step (e) and upon any deviation therebetween producing a command signal for varying at least one of the control inputs or outputs of the process until there is no deviation thereby assuring continuous production of the desired oxygen purity product.

12. The process of claim 11 wherein the second condenser/reboiler means is located in the low pressurize column.

13. The process of claim 11 wherein the second condenser/reboiler means is located in the high pressure column.

14. The process of claim 11 wherein the second condenser/reboiler means is located in a separate area outside the low pressure and high pressue column.

15. The process of claim 11 wherein said compositional variable is obtained from two selected areas within the low pressure column.

16. The process of claim 11 wherein said compositional variable at the condenser/reboiler means is selected from the group consisting of temperature, pressure, nitrogen and oxygen; and the compositional variable at the selected area is selected from the group consisting of temperature, pressure, nitrogen and oxygen.

17. The process of claim 11 wherein the compositional variable at the condenser/reboiler means is temperature; and the compositional variable at the selected area is temperature.

18. The process of claim 11 wherein the compositional variable is taken at the second condenser/reboiler means.

19. The process of claim 18 wherein said compositional variable is obtained from two selected areas within the column.

20. The process of claim 18 wherein said compositional variable at the second condenser/reboiler means is selected from the group consisting of temperature, pressure, nitrogen and oxygen; and the compositional variable at the selected area is selected from the group consisting of temperature, pressure, nitrogen and oxygen.

21. The process of claim 18 wherein the compositional variable at the second condenser/reboiler means is temperature; and the compositional variable at the selected area is temperature.

22. The process of claim 18 wherein the command signal controls the oxygen production rate of the system.

23. The process of claim 18 wherein the command signal controls the feed air flow rate of the system.

24. The process of claim 11 wherein the command signal controls the oxygen production rate of the system.

25. The proces of claim 11 wherein the command signal controls the feed air flow rate of the system.

* * * * *